United States Patent [19]

Shirey

[11] Patent Number: 4,535,580

[45] Date of Patent: Aug. 20, 1985

[54] SCREW SLOT RUNNER SYSTEM

[75] Inventor: Richard Shirey, Avon, Ohio

[73] Assignee: Donn Incorporated, Westlake, Ohio

[21] Appl. No.: 500,943

[22] Filed: Jun. 3, 1983

Related U.S. Application Data

[63] Continuation-in-part of Ser. No. 281,829, Jul. 9, 1981, abandoned, which is a continuation-in-part of Ser. No. 267,737, May 28, 1981, abandoned.

[51] Int. Cl.[3] ..... C04B 5/52

[52] U.S. Cl. ..... 52/484; 52/475; 52/665

[58] Field of Search ..... 52/484, 665, 726, 730, 52/486, 488, 664, 666, 728, 739, 762, 475; 403/347, 216, 217

[56] References Cited

U.S. PATENT DOCUMENTS

| | | | |
|---|---|---|---|
| 2,840,200 | 6/1958 | Wong | 403/347 |
| 3,284,977 | 11/1966 | Lickliter et al. | 52/726 X |
| 3,835,614 | 9/1974 | Downing, Jr. | 52/484 X |
| 4,019,300 | 4/1977 | Sauer et al. | 52/665 |
| 4,021,986 | 5/1977 | McCall et al. . | |
| 4,047,348 | 9/1977 | McSweeney | 52/484 |
| 4,206,578 | 6/1980 | Mieyal | 52/730 |
| 4,485,605 | 12/1984 | LaLonde | 52/484 X |

*Primary Examiner*—Donald G. Kelly
*Assistant Examiner*—Richard E. Chilcot, Jr.
*Attorney, Agent, or Firm*—Pearne, Gordon, Sessions, McCoy, Granger & Tilberry

[57] ABSTRACT

A screw slot runner system for suspension ceiling grids is disclosed. The system provides runners having a central web, an enclosed bulb at the upper edge of the web, and a downwardly opened channel at the lower edge of the web. Opposing, inturned lips define the channel opening and permit insertion of T-bolts or the like to support accessories from the grid system. The runner connections are structured to provide a mitered type joint appearance even though a full miter joint is not provided. In one embodiment, separate end connector clips are provided to join main run runner modules, and the connector clips are provided with openings through which cross run end connectors project to interconnect the cross runs and main runs.

10 Claims, 12 Drawing Figures

SCREW SLOT RUNNER SYSTEM

This is a continuation-in-part of my copending application Ser. No. 281,829, filed July 9, 1981, abandoned May 5, 1983, which is a continuation-in-part of my abandoned application 267,737 filed May 28, 1981.

BACKGROUND OF THE INVENTION

This invention relates generally to grid systems for suspension ceilings or the like, and more particularly to a novel and improved screw slot grid system for suspension ceilings.

Prior Art

Screw slot grid systems for suspension ceilings are known. Such systems are often used where it is necessary to mount an accessory for support by the ceiling grid system. For example, in hospitals it is often necessary to mount a curtain track on the ceiling so that a privacy curtain can be drawn around a patient's bed. When the ceiling is formed with a screw slot grid, it is a simple matter to mount the track along substantially any portion of the ceiling by inserting a T-bolt fastener in the screw slot at intersections between the track and the grid and then mount the track on the T-bolt.

Because the T-bolt can be positioned substantially anywhere on the grid, it is possible to mount the track in substantially any desired location. An example of one type of prior art screw slot grid or runner system is described in U.S. Pat. No. 4,021,986, and such patent is incorporated herein by reference.

SUMMARY OF THE INVENTION

There are several important aspects of this invention. In accordance with one important aspect of the invention, a novel and improved joint structure is provided for screw slot runner systems. Such joint structure is arranged to provide an improved ceiling appearance in which the exposed portions of the grid appear to provide a mitered joint to eliminate the butt joint appearance of the prior art.

The joint structure is also arranged so that the joint appearance is improved without unduly weakening the assembled structure. In one illustrated embodiment, the through members or main run members are notched out at locations where the ends of associated runners are connected and the end of the connecting runner extends into the notch. The notch depth, however, is sized so that the notch ends at a location spaced from the central web of the runner, leaving intact a partial flange to retain satisfactory runner strength past the joint notch.

The grid system may be installed as a basketweave grid system in which the grid members are provided with end connectors at each end which connect at intermediate locations on a perpendicularly extending through runner of the same structure. In such grid systems, there are no "main runs" as such.

In a second embodiment, a system is provided in which the grid includes typical "main runs" and cross runs, where cross runs are connected between parallel main runs. In such embodiment, the main runs are provided by a plurality of main run modules connected by separate connector clips. In such embodiment, the main runs are assembled from whatever number of modules are required to produce the required main run length. The ends of each main run module are shaped to provide one-half of a mitered joint and, when assembled with a connector clip, provide a full joint adapted to receive a cross run end. The opening through which the cross run end connector extends is provided in the connector clip itself so the associated cross run connector actually connects to the main run connector clip. The main run connector clip is structured to provide a strong end connection between aligned end-connected main run modules.

In a third embodiment the notch is formed to again provide the appearance of a miter joint but the notch extends upwardly only along the portion of the channel walls. Therefore the flange portions and a substantial portion of the channel walls remain intact past the joint for greater strength. In such embodiment the material notched from the inwardly extending lips and from the lower portion of the channel walls is bent back up along the channels walls so that there is no exposed raw edge visible in an assembled grid. Further, when the grid is formed from sheet material having one color applied to one side and another color on the other side, the bent back portion tends to obscure the existence of the remaining portion of the channel wall which extends through the joint.

The cross section of the grid runners provides a closed bulb at the upper extremity, a central web, and an open channel at the lower extremity. In the illustrated embodiment, a separate U-shaped reinforcing element is enclosed within the bulb to provide additional strength in the bulb.

These and other aspects of this invention are illustrated in the drawings, and are more fully described in the following specification.

DETAILED DESCRIPTION OF THE DRAWINGS

A suspension ceiling grid system in accordance with the present invention consists of an assembly of a plurality of runners interconnected to form rectangular or square openings proportioned to receive ceiling panels or, in some instances, lighting fixtures or the like. Such panels are supported at their edges within the openings by the grid system.

Figure 1:
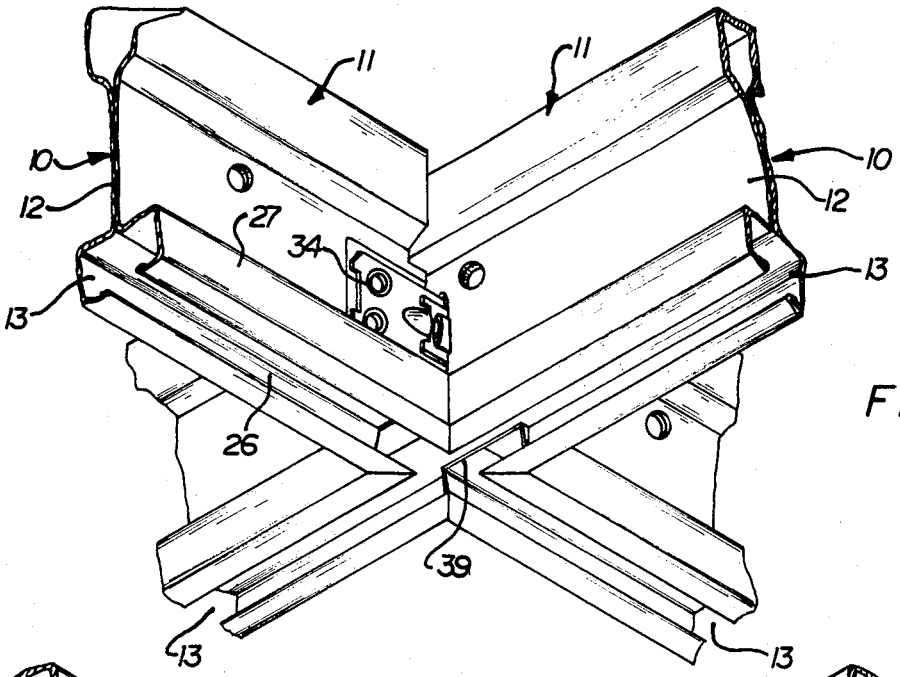
FIG. 1 is a perspective view of an assembled connection in a T-slot runner system in accordance with this invention.
Figure 2:
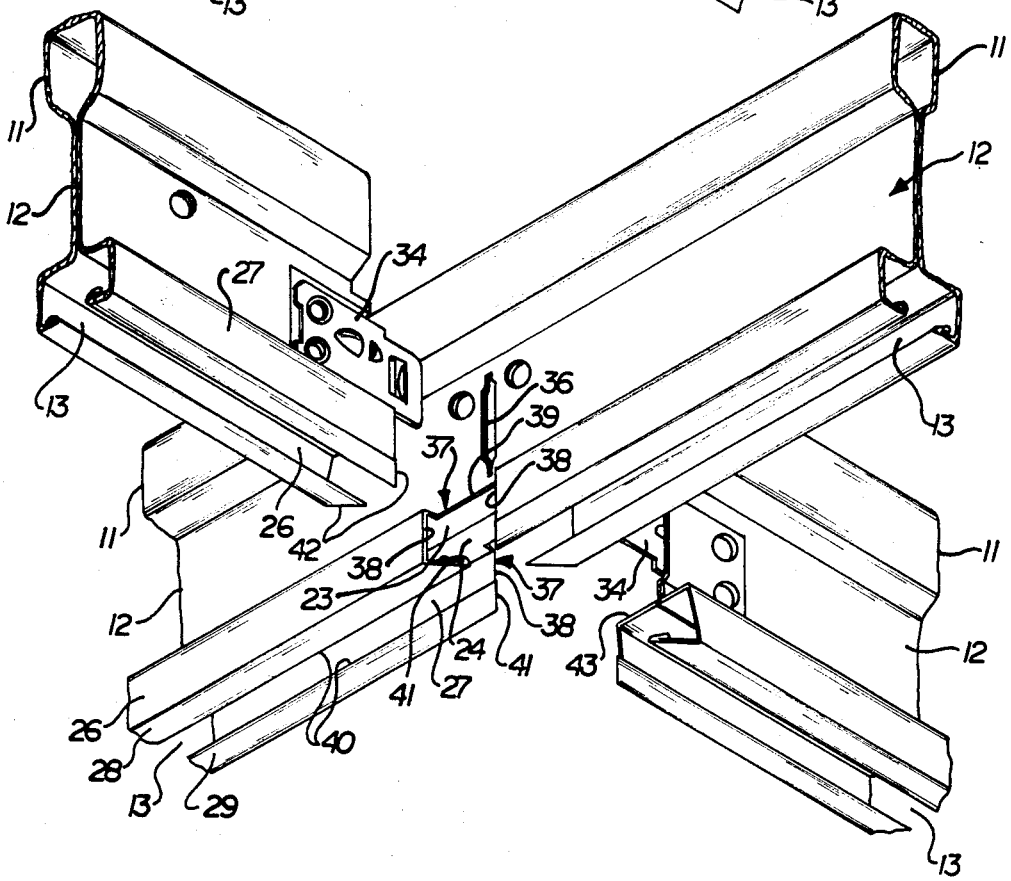
FIG. 2 is an exploded view similar to FIG. 1, illustrating the end connectors aligned with but spaced from the through member.
Figure 3:
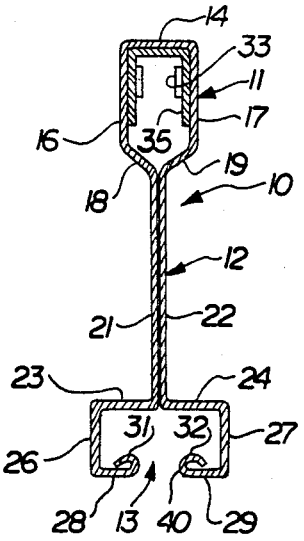
FIG. 3 is an enlarged cross section of the runners.

As best illustrated in FIGS. 1 through 3, the illustrated grid system is formed of runners 10 having a closed bulb 11 which is generally rectangular in shape, a central web 12, and an open channel 13 at their lower extremity. The runners are symmetrical about a central plane along which the central web 12 extends.

Referring to FIG. 3, the runner is formed of a shaped piece of sheet material, preferably sheet metal, providing a central portion 14 extending to spaced and parallel, depending walls 16 and 17 which form the sides of the bulb 11. At the lower extremities of the depending walls 16, the metal is bent inwardly to provide converging, inclined wall portions 18 and 19, which cooperate to form the lower portion of the bulb.

Extending downwardly in face-to-face adjacency are a pair of web portions 21 and 22 which cooperate to form a double thickness web 12 extending from the bulb 11 to the channel 13. At the lower extremity of the web portions 21 and 22, the material is bent in opposite directions to form flange portions 23 and 24 which cooperate to form the upper side of the channel 13. Depending channel wall portions 26 and 27 respectively extend from the extremities of the flange portions 23 and 24 in spaced and parallel relationship, and cooperate to define the sidewalls of the channel 13. At the lower extremity of each of the channel wall portions 26 and 27, the material is inturned to provide converging lips 28 and 29. At the inner ends of each lip the material is bent back upon itself at 31 and 32 to provide additional stiffness and a finished edge 40. The edges 40 of the lips are spaced apart a small distance so that a T-bolt or the like can be inserted into the channel and after being rotated 90 degrees, is supported on the lips within the channel so that the shank of the bolt extends down from the runner. Such T-bolts (not illustrated) can be positioned at any desired location along the channel 13 and provide a simple structure for supporting substantially any desired items, such as a curtain track or the like, from the grid system. Similarly, lighting fixtures or other types of accessories can be supported from the grid system in this convenient manner.

In order to provide additional strength and rigidity in the bulb 11 of the runners, it is preferable to enclose within the bulb a U-shaped reinforcing element 35 which extends along the central portion 14 and down along each of the depending walls 16 and 17. Such reinforcing member is preferably lance-stitched at 33 to the depending walls. Such reinforcing member is not illustrated in FIGS. 1, 2, 11 and 12 for purposes of simplification. Reference should be made to U.S. Pat. No. 4,206,578, assigned to the assignee of the present invention, for a more detailed description of the manner in which such reinforcing elements are incorporated into the bulbs of suspension ceiling runners.

Mounted on the ends of the cross runners used in main run-cross run grid systems and on the ends of the runners used in a basketweave grid system are end connectors 34, which project through an opening 36 formed in the web 12 of the through runner, as best illustrated in FIGS. 2 and 3. The structure of such end connectors and the manner of interconnecting when inserted from opposite sides through the opening 36 are fully described in U.S. Pat. No. 4,108,563, which is incorporated herein by reference for such description.

At each location where a perpendicular runner is to be connected, the through runners are provided with a notch (best illustrated in FIG. 2) which receives the mating end of the connecting runner. A similar notch is formed in each side of the runner which respectively cut through the channel wall portions 26 and 27 to provide side edges 38 which are spaced apart a distance necessary to receive the channel sidewalls 26 and 27 of the connecting runner with a small clearance. In addition, the flange portions 23 and 24 are cut back at the notch through a distance of approximately one-half their lateral width to a longitudinal edge 39. By forming the notch 37 so that it extends only a portion of the way along the flange portions 23 and 24, a structure is provided in which a substantial part of the flange portions remains intact to provide runner strength past the connecting notch.

At the notch, the ends of the converging lips 28 and 29 are cut at a 45-degree angle to provide mitered ends 41 which mate with mitered ends 42 of the connecting runner so as to provide an attractive miter-type joint between the intersecting lips of connecting runners, as best illustrated in FIG. 1. This structure, therefore, eliminates the butt type connector appearance of the prior art as exemplified by U.S. Pat. No. 4,021,986, supra.

In addition, the illustrated embodiment locates the edge 39 in vertical alignment with the inner edges 40 of the converging lips 28 and 29 of the through runner so that the joint provided by the abutting ends 43 and the edges 39 is in vertical alignment with the inner edges 40 of the converging lips in an assembled grid and tends to be obscured from view when the grid system is viewed from the room in which it is installed. Consequently, the visual impression provided in an installed grid system is that a full miter joint is provided at each intersecting connection even though part of the flange portion remains to extend past the connection and provide additional strength. Further, the channel wall portions 26 and 27 of the connecting members extend past the edges 38 of the through member with a close fit to provide a strong, fully stabilized interconnection between the runners which resists any tendency for the connecting runners to twist with respect to the through runners.

Figure 4:
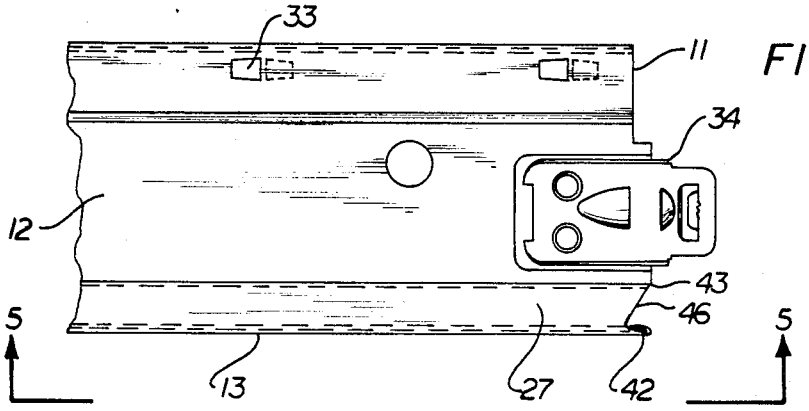
FIG. 4 is a side elevation of the end of a runner used in either the basketweave system or as a cross runner in a main run cross run-type system.
Figure 5:
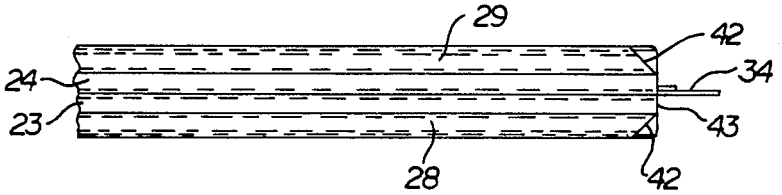
FIG. 5 is a bottom view, taken along line 5—5 of FIG. 4.
Figure 6:
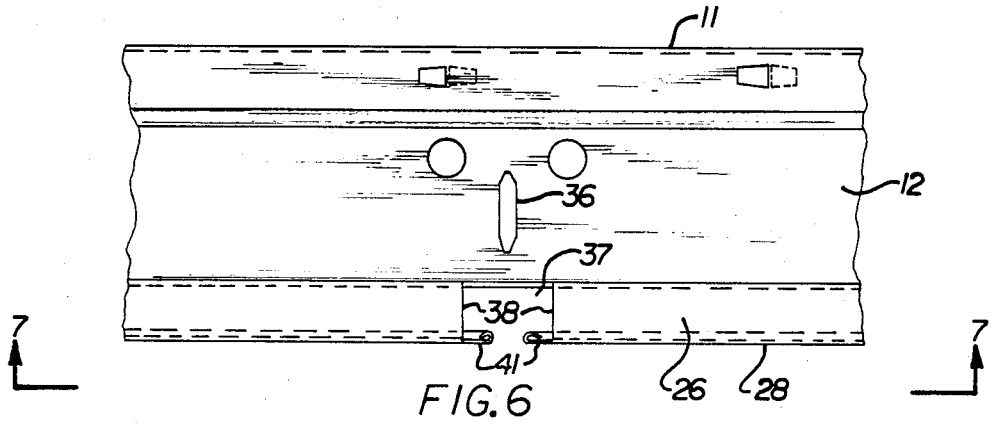
FIG. 6 is a side elevation of a through runner illustrating the structure adapted to receive the end connection of FIGS. 4 and 5.
Figure 7:
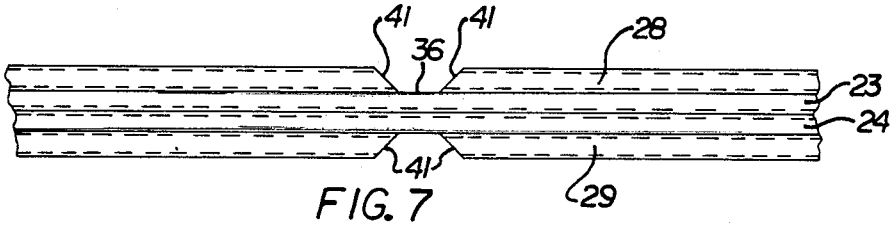
FIG. 7 is a bottom view taken along line 7—7 of FIG. 6.

As best illustrated in FIG. 4, the ends of the channel wall portions 26 and 27 are inclined forwardly from the end of the miter joint 42 and the end 43. This ensures that the channel sidewall portion of a connecting runner extends into the notch formed between the edges 38 of the through runner.

Figure 8:
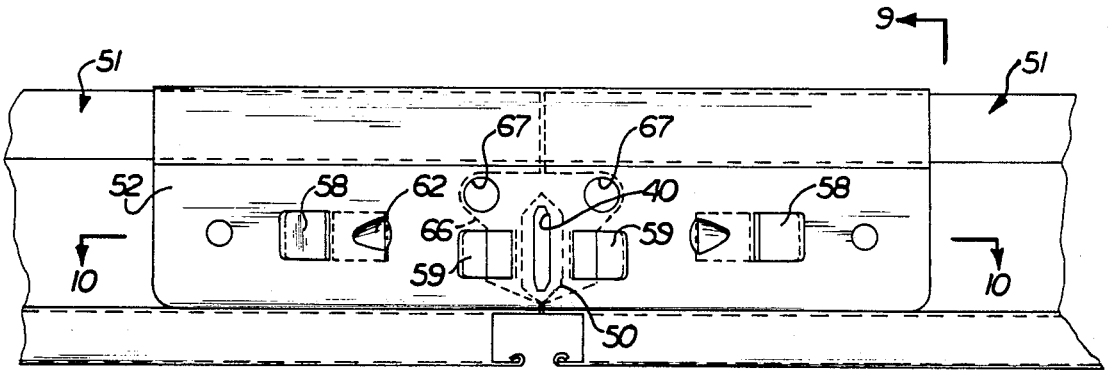
FIG. 8 is a side elevation of the end connection of a main run system in which a connector clip is used to connect a pair of aligned main run modules.
Figure 9:
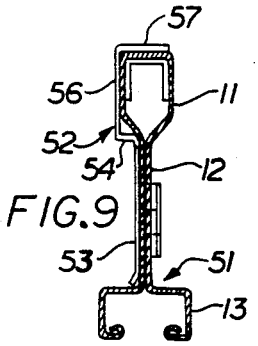
FIG. 9 is a cross section taken along line 9—9 of FIG. 8.
Figure 10:
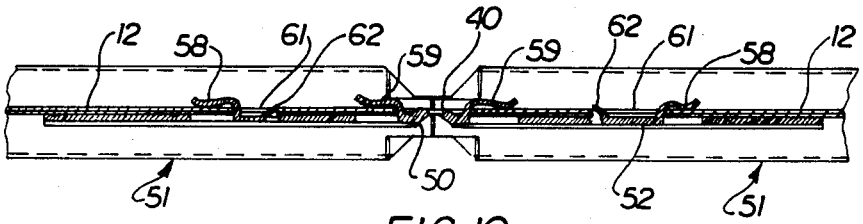
FIG. 10 is a cross section taken along line 10—10 of FIG. 8, illustrating the connection between the main run modules and the main run connector clip.

A second embodiment is illustrated in FIGS. 8 through 10 in which a connector clip is provided to assemble runner modules in an end-to-end relationship to provide main runs of substantially any length.

The main run modules 51 are provided with the same cross section as in the first embodiment, and therefore provide a bulb 11, a web 12, and an open channel 13. The ends of the modules 51, however, are provided with a shape allowing the modules to be connected together by a connector clip 52 having a first or web mating portion 53 which, in an assembly, extends along one side of the web 12 from the channel at its lower edge to the bulb 11 at its upper edge. The clip also provides a lateral portion 54 extending to a bulb engaging portion 56, which engages one side of the bulb 11 and extends to a lateral portion 57 which engages the upper wall of the bulb 11.

A snap-in locking system, best illustrated in FIG. 10, is provided to interconnect the runner modules 51 and the clip 52. Such locking system includes two tabs 58 and 59 which cooperate to lock with each of the runner modules 51 by extending through an opening 61 in the web 12 in the case of the tabs 58 and extending over the end edge of the web 12 in the case of the tabs 59. The clip is assembled with the respective runners by merely aligning the two and then moving the clip and runner axially with respect to each other until the assembled position of FIG. 10 is reached. In such position, a projection 62 on the clip associated with each of the runner modules 51 snaps into the opening 61 in the web 12 to engage the edge thereof opposite the tab 58. This provides a locking connection which prevents the clip from being removed from the end of the associated runner and, in effect, is a permanent connection which is easily created by slipping the parts together.

The ends of the runner modules are formed with one-half of a notch structure 37 so that when the adjacent ends of the two runner modules are connected by the connector 52, they cooperate to provide a connector notch 37 having the same structure described above in connection with the first embodiment. Therefore, the structural detail is not again set forth, and the previous description applies to this embodiment.

In addition, the ends of the webs of the runner modules are cut back, as indicated by the dotted line 66, so that the connector clip 52 is exposed on both sides of the assembly. Located in the connector clip is an opening 40 having the same shape as the opening 36 of the first embodiment, and which is adapted to receive end connectors 34 discussed above. The material of the clip around the opening 40 is deformed laterally, as indicated by the dotted line 50 in FIG. 8, so that the opening is displaced from the plane of the clip back to the plane of the web 12, as indicated in FIG. 10. Therefore, the end connectors of the cross runners are properly centered and the joint fits properly.

Once the assembly is formed by connecting adjacent runner modules with a connector 52, cross runners having the same end configuration discussed above are attached at the intersections by inserting the connectors 34 from opposite sides through the opening 36'. Preferably, the ends of the runners are shaped so that they do not overlap the openings 67 formed in the mounting clip through which support wires may be inserted to suspend the runner assembly.

The connector clip 52 is preferably formed of a material somewhat thicker than the material used to form the runners, so that a strong bridging connection is provided between the adjacent runner modules. Further, because the connector clip extends along the web and up around one side of the bulb, a strong connection is provided in which the connection is substantially as strong as the runner modules along their lengths. With this embodiment, main runs of substantially any length can be assembled from an appropriate number of runner modules. Further, since the support wires can be put in place on the connector before the connector is assembled with a given runner module, a given runner can be assembled in its installed position.

Figure 11:
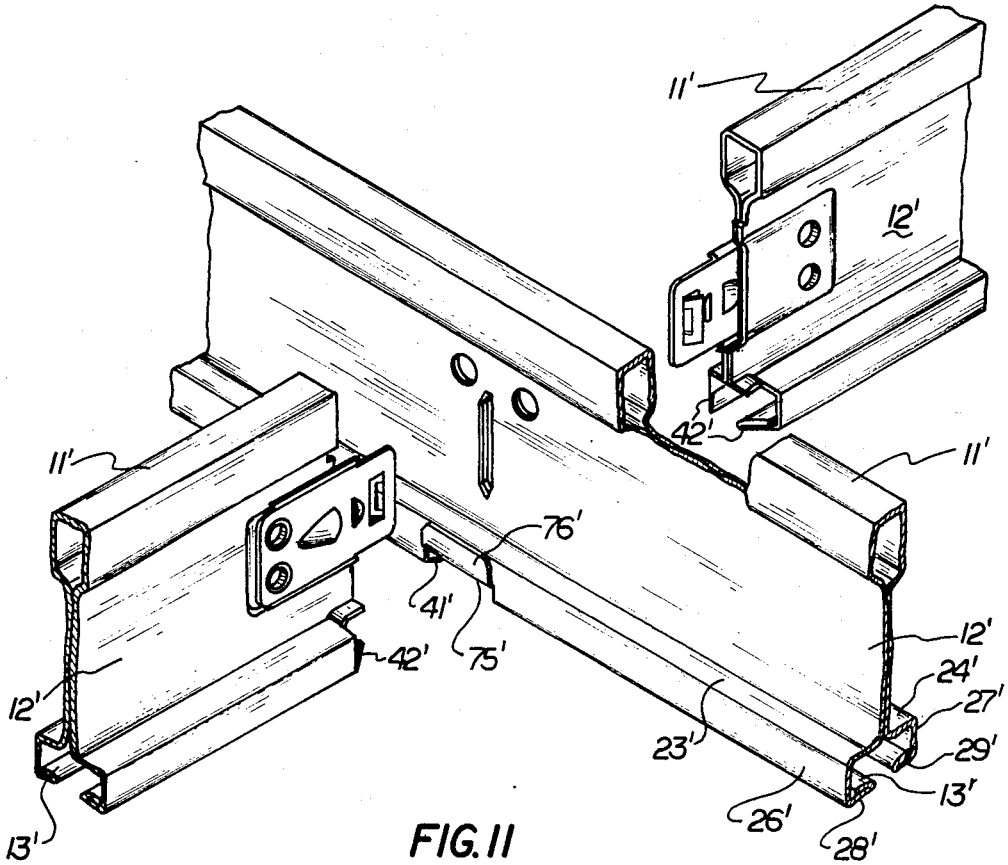
FIG. 11 is a fragmentary exploded perspective view of a modified joint structure.
Figure 12:
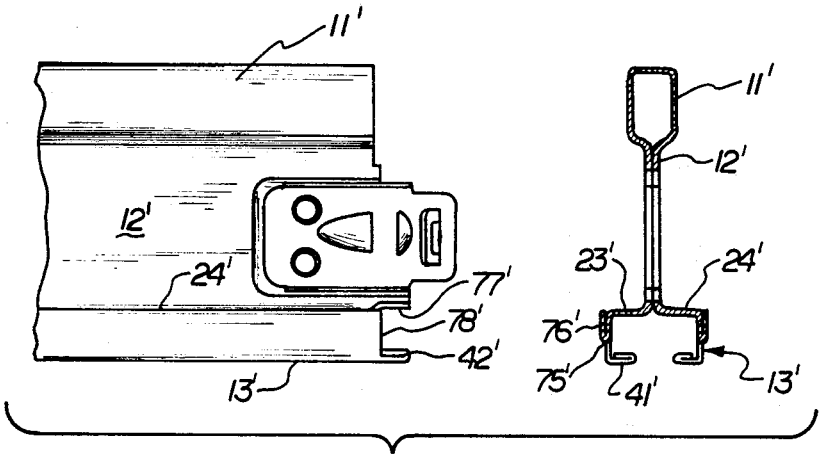
FIG. 12 is a fragmentary cross section through the joint of the embodiment of FIG. 11.

FIGS. 11 and 12 illustrate another embodiment of this invention in which the notch formed at the intersections is modified for improved strength and appearance. In this embodiment similar reference numerals are used to designate similar structural parts but a prime (') is added to indicate that reference has been made to this embodiment.

The runners of the embodiment of 11 and 12 are formed with the same cross section as the runners of FIGS. 1 through 10. Therefore they provide a closed bulb 11', a double layered web 12' and an open channel 13' at their lower extremities. The notches in the channel portions are formed to provide mitered 41' along the lips 28' and 29' which mate with the mitered ends 42' of the connecting runners so as to provide a mitered joint appearance.

The notch is also cut up along the channel wall portions 26' and 27' a short distance. In this embodiment the notch extends up along the channel wall portions 26' and 27' a distance which is no greater than one half of the height of the channel wall portions so at least one half of the channel wall portions are uninterrupted and extend past the notches. Further since the notches terminate at a location space below the flange portions 23' and 24' such flanges are uninterrupted and extend past the notches.

Preferably the material cut from the lips and wall portions to form the notches is bent back along the exterior of the remaining wall portions to provide a finished edge 75' and a reversely bent portion 76'.

The ends 77' of the flanges 23' and 24' of the connecting runner are displaced upwardly a small amount and extend over the associated flanges 23' or 24' of a through runner when the connection is made. The ends 78' of the channel walls extend vertically from the mitered ends 42' to the flanges and when assembled abut the uninterrupted portions of the associated channel wall of the through runner.

Tests conducted on this embodiment have established that the modified notch structure does not weaken the structure of the assembled grid quite as much as the structure of the first embodiment and therefore the structure of this embodiment provides a somewhat better strength in an assembled grid.

However the provisions of a notch structure which leaves the majority of the channel side walls extending uninterrupted past the notches provides a very substantial improvement in the ability of the grid to resist lateral loading. Therefore this embodiment is much less likely to buckle laterally during the handling of the runner prior to and during its installation in a grid. This ability to withstand lateral loading and to resist buckling during handling is very important since if a runner buckles it cannot be used and must be discarded.

By bending the notched out material back along the channel walls a raw edge which would otherwise exist is eliminated at the notch. Such raw edge is undesirable since runners are usually formed of painted or coated stock and a raw edge would cause the base metal to show and would distract from the desirable appearance of the grid at the intersections.

Further in many instances the runners are formed of material having one color on one side and another color on the other side. For example, one side might be white and the other side black. In such instances the runner forming operations would be performed so that the inside of the channel exposes the black coated side to provide contrast with the lips which are white. When contrasting colors are presented the bent portion 76' covers the outer surface of the channel wall portion within the channel and hides the existence of the uninterrupted portion of the channel walls. Therefore the channels in an installed system appear from below to provide an uninterrupted dark colored channel even at the intersections and the portion of the channel wall extending through the intersection is obscured.

The flange ends which extend up over the associated flanges of the through runner improves vertical stability and also conceals the joint between the flanges of the through runner and the flanges of the connecting runner. In practice it has been found that an intersection constructed in accordance with this embodiment provides the appearance of a miter joint and the appearance of an intersection of uninterrupted channels.

Although the preferred embodiments of this invention have been shown and described, it should be understood that various modifications and rearrangements of parts may be resorted to without departing from the scope of the invention as disclosed and claimed herein.

What is claimed is:

1. A suspension ceiling grid system comprising elongated runners formed with a bulb at their upper edge, a planar central web, and an open channel at their lower edge, said open channel being defined by lateral flanges extending in opposite directions from the lower edge of said web, a pair of laterally spaced, substantially parallel channel sidewalls, and inturned lips extending laterally toward each other from said sidewalls and terminating at spaced and opposed inner edges, said lips cooperating to define a longitudinal opening along the lower side of said channel, said grid system including first runners having end connectors adapted to connect with second runners at predetermined locations, said second runners providing notches in their channels at said locations, said notches extending through said lips and a first portion of the associated sidewalls adjacent to said lips leaving intact a second portion of said sidewalls and said flanges extending uninterrupted past said notch, said lips at the ends of said first runners and adjacent to the notches of said second runners being shaped to fit together to form a miter joint when said runners are interconnected, said second portions providing substantial resistance to buckling of said runners at said notches when lateral load are applied thereto.

2. A suspension ceiling grid system as set forth in claim 1 wherein said first portions of said side walls are bent back along said second portions to eliminate a raw edge along the lower edge of said second portion and to obscure said second portion from view when said runners are assembled in a grid system.

3. A suspension ceiling grid system as set forth in claim 2 wherein said runners are formed of sheet metal coated with a first color on one side and a second contrasting color on the other side, said one side providing the lower surface of said lips and the other side providing the exposed surfaces within said channel along said flanges and said channel sidewalls, said first portion of said sidewalls which is bent back along said second portion covering said one side of said second portions and exposing said other side along the exterior of said second portions to obscure the presence of said second portions within said channels.

4. A suspension ceiling grid system as set forth in claim 2 wherein said second portion of said side walls extend from said flanges toward said lips through a distance at least equal to one half the distance therebetween, said second portions contributing substantially to the lateral strength of said runners at said notches.

5. A suspension ceiling grip system as set forth in claim 1 wherein said second portions of said sidewalls extend from said flanges toward said lips for a distance at least equal to one half the distance therebetween, said second portions contributing substantially to the lateral strength of said runners at said notches.

6. A suspension ceiling grid system as set forth in claim 1 wherein said first runners provide upwardly offset flange portions at their ends which extend over and along the flange portions of said second runners when said runners are connected in said grid system, said offset portions of said flanges of said first runners tending to obscure the joint between said flanges in an assembled grid system.

7. A suspension ceiling grid system as set forth in claim 1, wherein said second runners are formed by separate runner modules adapted to be connected by a bridging connector clip, the ends of said runner modules being formed with opposed notch halves which cooperate when two runner modules are connected together to define a full notch.

8. A suspension ceiling grid system as set forth in claim 6, wherein said connector clips are formed with an opening, and said connectors of said first runners are adapted to project through said opening from opposite sides to provide an interconnection between said runners.

9. A suspension ceiling grid system as set forth in claim 8, wherein said connector clip fits along one side of said web and is deformed adjacent to said opening to position said opening in the plane of said web of said modules.

10. A suspension ceiling grid system as set forth in claim 9, wherein said clip provides a bulb engaging portion extending at least part way around said bulb to provide additional strength.

* * * * *